US009365909B2

(12) United States Patent
Tissot

(10) Patent No.: US 9,365,909 B2
(45) Date of Patent: Jun. 14, 2016

(54) HARDENING CELL

(71) Applicant: ECM Technologies, Grenoble (FR)

(72) Inventor: Gerard Tissot, Saint-Nazaire-les-Eymes (FR)

(73) Assignee: ECM TECHNOLOGIES, Grenoble (FR)

( * ) Notice: Subject to any disclaimer, the term of this patent is extended or adjusted under 35 U.S.C. 154(b) by 227 days.

(21) Appl. No.: 14/351,941

(22) PCT Filed: Oct. 18, 2012

(86) PCT No.: PCT/FR2012/052373
§ 371 (c)(1),
(2) Date: Apr. 15, 2014

(87) PCT Pub. No.: WO2013/057431
PCT Pub. Date: Apr. 25, 2013

(65) Prior Publication Data

US 2014/0284851 A1 Sep. 25, 2014

(30) Foreign Application Priority Data

Oct. 21, 2011 (FR) ..... 11 59543

(51) Int. Cl.
*C21D 1/62* (2006.01)
*C21D 1/767* (2006.01)
(Continued)

(52) U.S. Cl.
CPC *C21D 1/62* (2013.01); *C21D 1/767* (2013.01); *F27D 7/04* (2013.01); *F27D 9/00* (2013.01); *F27D 2009/0072* (2013.01); *F27D 2009/0075* (2013.01); *F27D 2009/0089* (2013.01)

(58) Field of Classification Search
CPC ..... C21D 1/62
USPC ..... 266/251, 44
See application file for complete search history.

(56) References Cited

U.S. PATENT DOCUMENTS

| | | | | |
|---|---|---|---|---|
| 4,836,776 | A | 6/1989 | Jomain | |
| 4,906,182 | A | 3/1990 | Moller | |
| 2003/0175130 | A1* | 9/2003 | Loeser | C21D 1/613 417/313 |

(Continued)

FOREIGN PATENT DOCUMENTS

| | | | |
|---|---|---|---|
| DE | 102008036490 | A1 | 2/2010 |
| FR | 2701096 | A1 | 8/1994 |
| FR | 2864106 | A1 | 6/2005 |

OTHER PUBLICATIONS

Search Report issued in PCT/FR2012/052373 on Feb. 18, 2013.

(Continued)

*Primary Examiner* — Scott Kastler
(74) *Attorney, Agent, or Firm* — Vedder Price, P.C.

(57) ABSTRACT

A cell for quenching a charge under an atmosphere of gas comprises a centrifugal or helicon-centrifugal impeller comprising a gas intake opening and gas discharge openings. The impeller is rotated by a motor to cause a flow of the gas between the charge and a heat exchanger. The quenching cell comprises first and second mobile half-volutes. In a first position, the first half-volute guides the gas discharged by a first part of the discharge openings and the second half-volute closes off a first portion of the intake opening. In a second position, the second half-volute guides the gas discharged by a second part, different from the first part, of the discharge openings and the first half-volute shuts off a second portion of the intake opening.

9 Claims, 5 Drawing Sheets

(51) Int. Cl.
*F27D 7/04* (2006.01)
*F27D 9/00* (2006.01)

(56) References Cited

U.S. PATENT DOCUMENTS

2010/0196836 A1 8/2010 Moller
2014/0284851 A1* 9/2014 Tissot ..... C21D 1/767
266/44

OTHER PUBLICATIONS

Written opinion issued in PCT/FR2012/052373, Dec. 2012.

* cited by examiner

HARDENING CELL

BACKGROUND

The present disclosure relates to a cell for quenching pieces, for example, steel pieces.

DISCUSSION OF THE RELATED ART

Quenching corresponds to an abrupt cooling of a piece, also called load, which has been heated beyond a temperature at which the piece has its structure modified, to obtain a specific phase which is normally stable at high temperature only. For certain materials, particularly certain metals, quenching enables to maintain at ambient temperature the specific phase which has advantageous physical properties. For other materials, particularly certain steels, a quenching can enable to transform the specific phase into a metastable phase which has advantageous physical properties. In this case, the specific hot phase is austenite, obtained by heating the steel pieces between 750° C. and 1,000° C. and the metastable phase is martensite. The quenching operation must be relatively fast and uniform so that the entire austenite turns into martensite with no forming of perlite or bainite, which have lower hardness properties than martensite.

In the case of a liquid quenching, the previously-heated piece is for example placed in a quench tank filled with a quenching liquid, for example, oil, stirred during the cooling.

The quenching may also be performed by the flowing of a quenching gas around the piece to be cooled. Gas quenching is generally performed by arranging pieces to be quenched in a quenching cell comprising a tightly closed enclosure and by circulating a quenching gas in the enclosure. Gas quenching methods have many advantages over liquid quenching methods, and especially the fact that the treated pieces come out dry and clean.

The gas quenching of steel pieces which have been previously submitted to a thermal treatment (heating before quenching, anneal, tempering . . . ) or to a thermochemical treatment (cementation, carbonitriding . . . ) is generally performed with a gas under pressure, generally between 4 and 20 bars. The quenching gas is, for example, nitrogen, argon, helium, carbon dioxide, or a mixture of these gases.

A quenching cell generally comprises at least one motor, generally an electric or hydraulic motor, rotating a stirring element, for example, a propeller, capable of circulating the quenching gas in the quenching cell. To obtain a fast cooling of the pieces introduced into the quenching cell, the quenching gas is usually circulated at the level of the pieces to be cooled at a high speed for the entire quenching operation.

For certain types of pieces, for example, when the pieces are solid, it may be difficult to obtain a uniform cooling of the pieces if the quenching gas flows in the quenching cell in the same direction during the entire quenching operation, and thus always reaches the pieces to be processed in the same way. In this case, it is desirable to be able to rapidly reverse the quenching gas flow direction at the level of the pieces to be cooled to improve the uniformity of the cooling.

A possibility to reverse the quenching gas flow direction is to use a stirring element having its rotation direction imposing the quenching gas flow direction. The quenching gas flow direction is then reversed by reversing the rotation direction of the stirring element. To achieve this, an electric or hydraulic motor, having a rotation direction capable of being reversed, may be used to rotate the stirring element. Another possibility is to provide a transmission system between the motor and the stirring element, which enables to reverse the rotation direction of the stirring element. It may however be difficult to reverse the rotation direction of an electric or hydraulic motor or to operate a transmission within a short time. The reversal of the quenching gas flow direction at the level of the pieces to be cooled can last for more than ten seconds.

Document US 2003/0175130 describes a quenching cell where the stirring element comprises centrifugal impellers which always rotate in the same direction. The cell further comprises a system for reversing the quenching gas flow direction at the level of the pieces to be cooled by using mobile flaps.

A disadvantage of such a gas quenching cell is that, in order to enable to reverse the quenching gas flow direction at the level of the pieces to be cooled, the quenching gas is radially expelled on the entire periphery of the impellers, directly into the enclosure. Whatever the quenching gas flow direction, part of the quenching gas expelled by the impellers is blocked by the flaps and loses a significant part of its kinetic energy before being recovered in the general quenching gas flow. The power efficiency of the quenching cell, for example corresponding to the ratio of the power introduced to drive the impellers for a given time period to the thermal power taken from the load by the quenching gas for this same time period, may thus be low.

SUMMARY

An object of an embodiment of the present invention is to obtain a quenching cell which has an improved power efficiency while enabling to rapidly reverse the quenching gas flow direction at the level of the pieces to be cooled.

Another object of an embodiment of the present invention is to obtain a quenching cell having a decreased bulk.

Thus, an embodiment of the present invention provides a gas quenching cell for a load. The cell comprises a centrifugal or mixed-flow impeller comprising a gas intake opening and gas discharge openings. The impeller is rotated by a motor to cause a gas flow between the load and a heat exchanger. The quenching cell comprises first and second mobile half-volutes. In a first position, the first half-volute guides the gas discharged by a first portion of the discharge openings and the second half-volute shuts off a first portion of the intake opening. In a second position, one of the first or second half-volute guides the gas discharged by a second portion, different from the first portion, of the discharge openings, and the other one of the first or second half-volute shuts off a second portion of the intake opening.

According to an embodiment of the present invention, the quenching cell comprises an actuator laterally shifting the first and second half-volutes with respect to the impeller.

According to an embodiment of the present invention, the quenching cell comprises an actuator rotating the first and second half-volutes with respect to the axis of the impeller.

According to an embodiment of the present invention, the quenching cell further comprises an enclosure containing the impeller, the load, and the heat exchanger; a panel located between the impeller and the load; and a plate connecting the enclosure to the panel and surrounding the impeller, the first and second half-volutes being arranged on either side of the plate.

According to an embodiment of the present invention, the quenching cell comprises a cylindrical portion in contact with the panel and, in the first position, the second half-volute extends between the impeller and the cylindrical wall and, in the second position, the first half-volute extends between the impeller and the cylindrical wall.

According to an embodiment of the present invention, the actuator comprises a worm and a nut fastened to the first half-volute and cooperating with the worm.

According to an embodiment of the present invention, the quenching cell comprises an additional centrifugal or mixed-flow impeller, the impeller and the additional impeller being arranged on either side of the load, the cell further comprising third and fourth additional mobile half-volutes. In the first position, the third half-volute guides the gas discharged by a first portion of the discharge openings of the additional impeller and the fourth half-volute shuts off a first portion of the intake opening of the additional impeller. In the second position, one of the third or fourth half-volute guides the gas discharged by a second portion of the discharge openings of the additional impeller, different from the first portion of the discharge openings of the additional impeller, and the other one of the first or fourth half-volute shuts off a second portion of the intake opening of the additional impeller.

According to an embodiment of the present invention, the impeller is a mixed-flow impeller.

Another embodiment of the present invention provides a method of gas quenching of a load in a quenching cell such as previously described. The method comprises the steps of:

displacing the first and second half-volutes to the first position, the gas flowing at the load level in a first flow direction; and displacing the first and second half-volutes to the second position, the gas flowing at the load level in a second flow direction opposite to the first flow direction.

BRIEF DESCRIPTION OF THE DRAWINGS

The foregoing and other objects, features, and advantages will be discussed in detail in the following non-limiting description of specific embodiments in connection with the accompanying drawings, among which.

DETAILED DESCRIPTION

Figure 1:
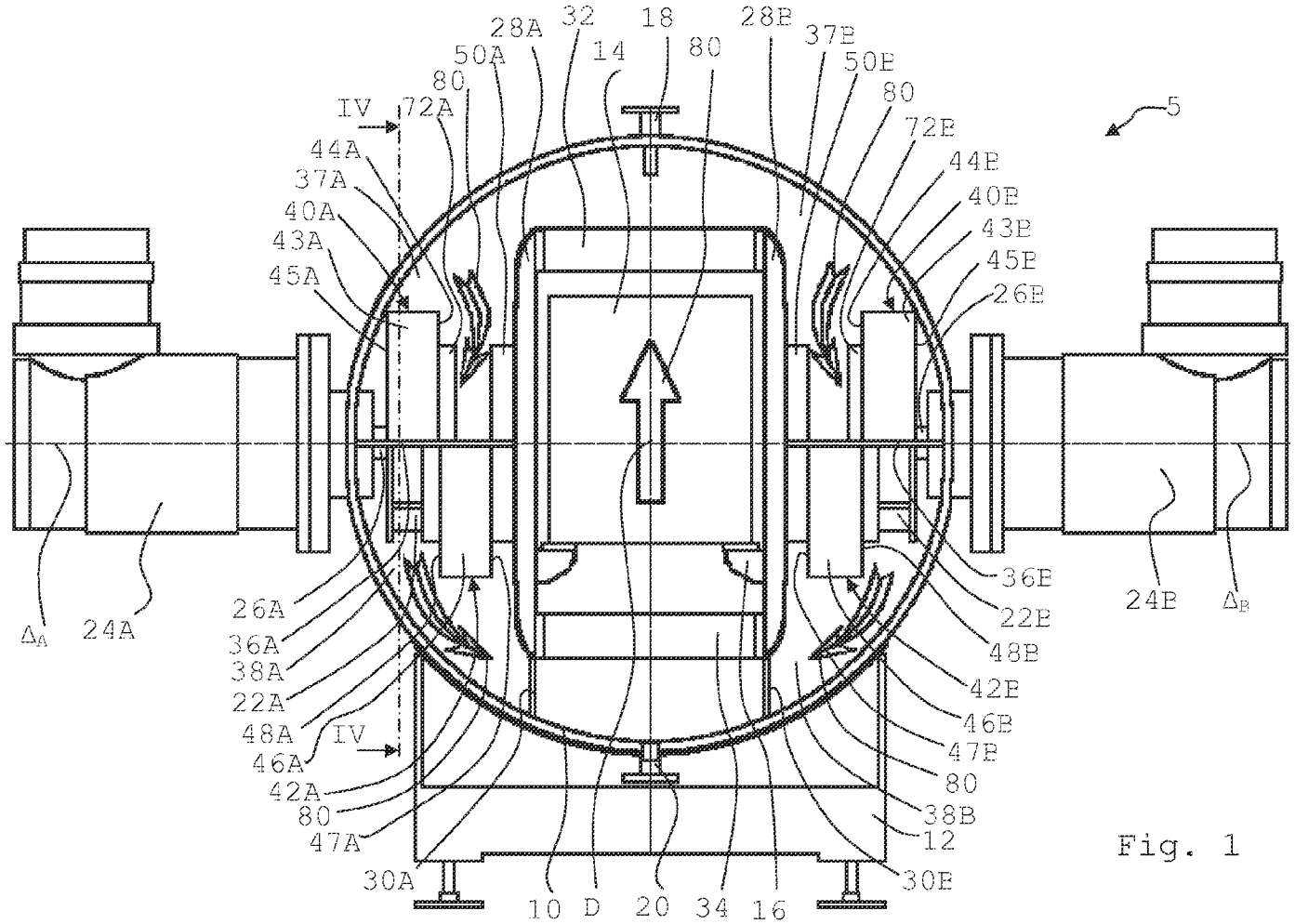
FIGS. 1 and 2 are simplified lateral views of an embodiment of a quenching cell with two operating steps.

The same elements have been designated with the same reference numerals in the different drawings. Further, only those steps and elements which are necessary to the understanding of the embodiment of the quenching cell and of the quenching method have been shown and described. Further, adjectives "lower", "upper", "above", and "under" and nouns "bottom" and "top" are used with respect to a reference direction which, in the quenching cell embodiment described hereafter, is the vertical direction. However, the reference direction may be inclined with respect to the vertical direction and may for example be horizontal.

Figure 2:
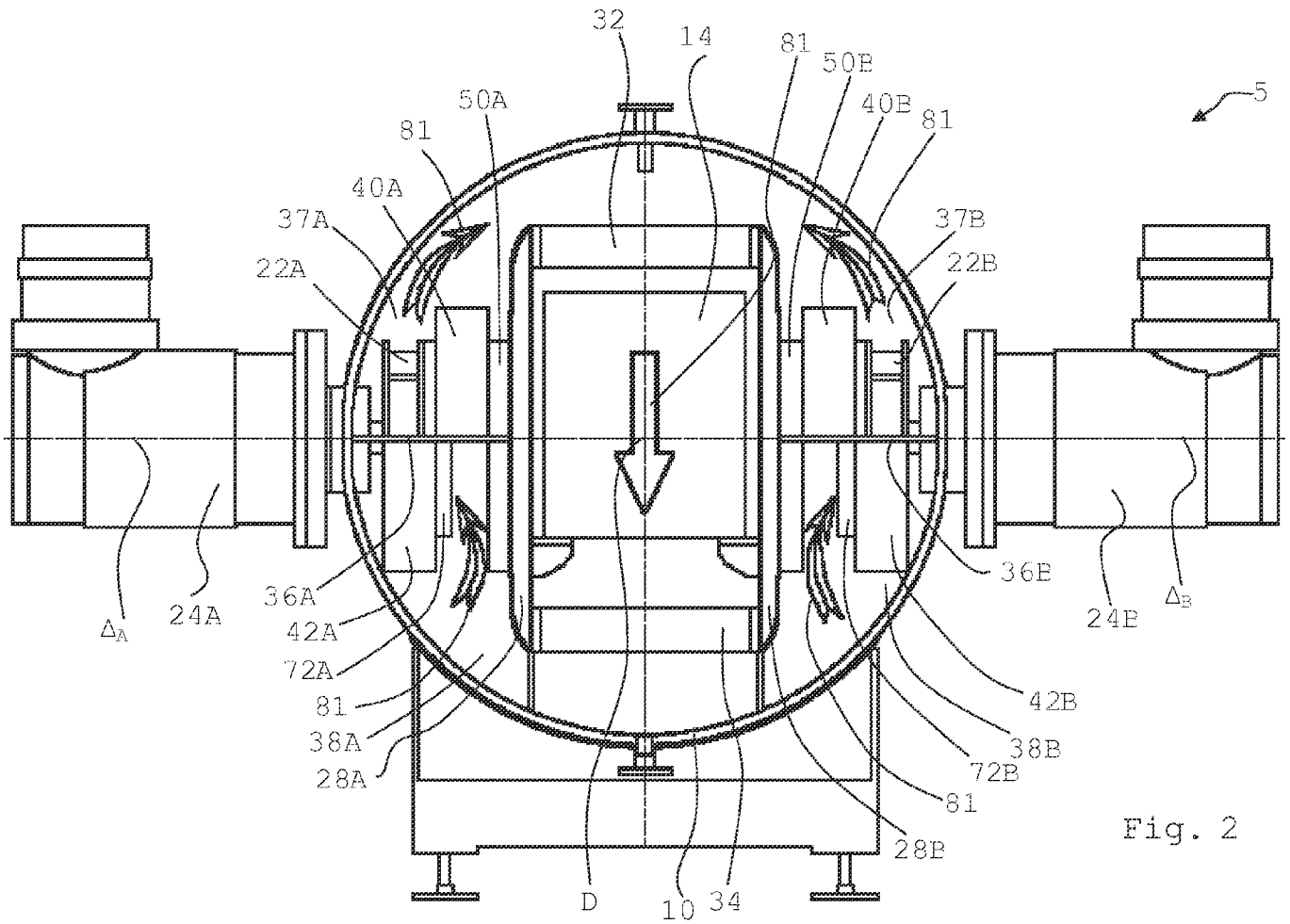

FIGS. 1 and 2 show simplified lateral views of an embodiment of a quenching cell according to the invention at two operating steps of a quenching method.

Cell 5 comprises an enclosure 10 for example having the general shape of a cylinder of horizontal axis D. As an example, the internal diameter of enclosure 10 may be in the order of 1 meter. As a variation, enclosure 10 may have a generally parallelepipedal shape. Enclosure 10 rests on a support 12. Cell 5 is closed at one end while the other end comprises a door system, not shown in FIGS. 1 and 2, providing access to cell 5 to introduce into it or extract therefrom a load 14 to be cooled. It may be a door sliding along a horizontal direction or a guillotine door. The door enables to substantially tightly close quenching cell 5. As a variation, cell 5 may comprise a door at each of its ends.

Load 14, schematically shown in FIGS. 1 and 2 as a rectangle, comprises a single piece or a plurality of pieces, for example, a large number of pieces arranged on an appropriate support. These may be steel pieces, for example, toothed wheels. Load 14 is maintained substantially at the center of cell 5 on rails 16.

A quenching gas may be introduced into enclosure 10 or extracted from enclosure 10 via valves 18, 20. The quenching gas for example is nitrogen, argon, helium, carbon dioxide, or a mixture of these gases. The quenching gas is circulated in enclosure 10 by impellers 22A, 22B having axes $\Delta_A$ and $\Delta_B$. Impellers 22A, 22B are for example, arranged on either side of load 14. Each impeller 22A, 22B may be a centrifugal or mixed-flow impeller. A centrifugal impeller is an impeller which sucks in a gas in a substantially axial direction and which discharges the gas in a substantially radial direction. An axial flow impeller is an impeller which sucks in a gas in a substantially axial direction and which discharges the gas in a substantially axial direction. A mixed-flow impeller is an impeller having an intermediate operation between the operation of an axial flow impeller and the operation of a centrifugal impeller, that is, the mixed-flow impeller sucks in a gas in a substantially axial direction and discharges the gas on its periphery along directions inclined with respect to the impeller axis with a pitch greater than zero and smaller than 90°.

As an example, axes $\Delta_A$ and $\Delta_B$ are horizontal, confounded, and located in the median horizontal plane of enclosure 10. A vacuum pump, not shown, may be connected to enclosure 10 and enable to create a partial vacuum in enclosure 10.

Each impeller 22A, 22B is rotated by a motor 24A, 24B. Motors 24A, 24B may be electric motors or hydraulic motors. They may be motors 24A, 24B which can only operate in one rotation direction. The axis of drive shaft 26A of motor 24A is confounded with axis $\Delta_A$ of impeller 22A. Drive shaft 26A is attached at one end to impeller 22A. The axis of drive shaft 26B of motor 24B is confounded with axis $\Delta_B$ of impeller 22B. Drive shaft 26B is attached at one end to impeller 22B. Motors 24A, 24B are arranged outside of enclosure 10 and on either side of enclosure 10 in tight casings, only drive shafts 26A, 26B being partly arranged in enclosure 10.

Cell 5 comprises, on either side of load 14, vertical panels 28A, 28B which extend substantially along the entire length of enclosure 10 along axis D. Each panel 28A, 28B rests on legs 30A, 30B fastened to enclosure 10. Rails 16 may be fastened to panels 28A, 28B. The quenching gas cannot flow through panels 28A, 28B, but can flow under panels 28A, 28B between legs 30A, 30B, and above panels 28A, 28B, the top of panels 28A, 28B having no contact with enclosure 10.

A first heat exchanger 32 is held between panels 28A, 28B above load 14. A second heat exchanger 34 is held between panels 28A, 28B above load 14. Exchangers 32, 34 are schematically shown as rectangles in FIGS. 1 and 2. In operation, the quenching gas is cooled by flowing through heat exchangers 32, 34. As an example, each heat exchanger 32, 34 comprises parallel tubes having a cooling liquid flowing therethrough.

Quenching cell 5 comprises a planar horizontal separation plate 36A, 36B, for each impeller 22A, 22B. The median plane of separation plates 36A, 36B contains axes $\Delta_A$ and $\Delta_B$. Each plate 36A, 36B connects enclosure 10 to the associated vertical panel 28A, 28B, substantially along the entire length of enclosure 10 along axis D. Each plate 36A, 36B comprises an opening, only opening 39A being shown in FIGS. 4 and 6, especially providing a passage for impeller 22A, 22B and drive shaft 26A, 26B. Each plate 36A, 36B separates the internal volume of cell 5, located between enclosure 10 and panel 28A, 28B, into an upper area 37A, 37B located above plate 36A, 36B and a lower area 38A, 38B located above plate 36A, 36B.

Cell 5 comprises, for each impeller 22A, 22B, an upper half-volute 40A, 40B, located above separation plate 36A, 36B, and a lower half-volute 42A, 42B, located under separation plate 36A, 36B.

Each upper half-volute 40A, 40B comprises a lateral wall 43A, 43B, a planar inner wall 44A, 44B, and a planar outer wall 45A, 45B. Planar walls 44A, 44B, 45A, 45B are perpendicular to axes $\Delta_A$ and $\Delta_B$ and comprise an inner edge corresponding to a circle portion having a diameter slightly greater than the maximum external diameter of impeller 22A, 22B. Each lower half-volute 42A, 42B comprises a lateral wall 46A, 46B, a planar inner wall 47A, 47B, and a planar outer wall 48A, 48B. Planar walls 47A, 47B, 48A, 48B are perpendicular to axes $\Delta_A$ and $\Delta_B$ and comprise an inner edge corresponding to a circle portion having a diameter slightly greater than the maximum external diameter of impeller 22A, 22B. Planar inner wall 44A, 44B, 47A, 47B is the planar wall closest to panels 28A, 28B and planar outer wall 45A, 45B, 48A, 48B is the wall most remote from panels 28A, 28B.

Cell 5 comprises, for each impeller 22A, 22B, a cylindrical wall 50A, 50B of axis $\Delta_A$ and $\Delta_B$ respectively. The inner diameter of cylindrical wall 50A, 50B is substantially equal to the maximum external diameter of impeller 22A, 22B. Cylindrical wall 50A, 50B is in contact with panel 28A, 28B.

Each half-volute 40A, 40B, 42A, 42B can be shifted along axis $\Delta_A$ (respectively $\Delta_B$) between a first position, called guiding position, where the half-volute is close to enclosure 10, and a second position, called screening position, where the half-volute is close to panel 28A, 28B. The system for displacing half-volutes 40A, 40B, 42A, 42B is not shown in FIGS. 1 and 2.

Figure 3:
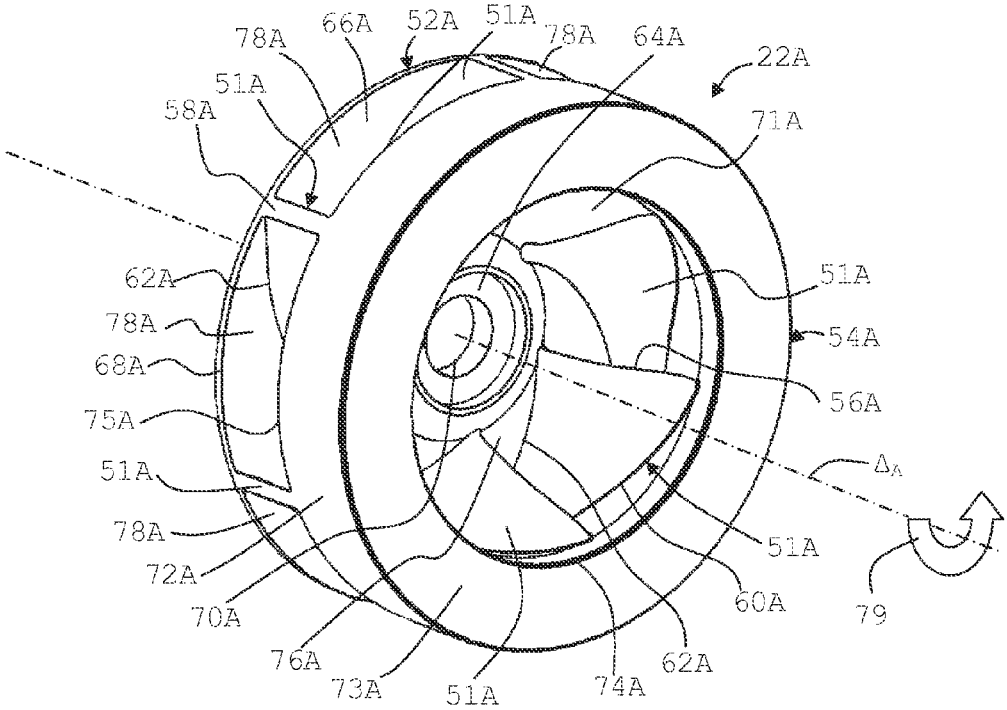
FIG. 3 is a perspective view of an embodiment of a mixed-flow impeller.

FIG. 3 shows a perspective view of impeller 22A. It is a closed mixed-flow impeller. Impeller 22B may be identical to impeller 22A. Impeller 22A comprises blades 51A maintained between a base flange 52A and a cover ring 54A. Each blade 51A has a front edge 56A, a rear edge 58A, and lateral edges 60A, 62A. Base flange 52A comprises a central support portion 64A and a planar portion 66A extending around support portion 64A. Planar portion 66A has, seen along axis $\Delta_A$, the shape of a ring of axis $\Delta_A$ and comprises a circular outer ring 68A. Support portion 64A is crossed by an opening 70A for the passage of drive shaft 26A, not shown in FIG. 3. Lateral edge 62A of each blade 51A is attached to planar portion 66A and extends from outer edge 68A of planar portion 66A to support portion 64A.

Cover ring 54A is a piece having a symmetry of revolution around axis $\Delta_A$ and comprises an internal wall 71A, a lateral wall 72A, and a front wall 73A. Lateral wall 72A is a cylindrical wall of axis $\Delta_A$ having the same diameter as circular outer edge 68A of base flange 52A. Front wall 73A is a planar wall having, seen along axis $\Delta_A$, the shape of a ring of axis $\Delta_A$ having its outer edge in contact with lateral wall 72A and comprising a circular inner edge 74A having a diameter smaller than the diameter of lateral wall 72A. Internal wall 71A connects circular inner edge 74A to lateral wall 72A. Lateral wall 72A comprises a circular edge 75A in contact with blades 51A. Internal wall 71A connects circular inner edge 74A to circular edge 75A.

Lateral edge 60A of each blade 51A is attached to internal wall 71A and extends from circular edge 75A to circular inner edge 74A. Circular inner edge 74A delimits intake opening 76A of impeller 22A. Rear edges 58A of blades 51A and circular edges 68A, 75A delimit discharge openings 78A of impeller 22A.

In operation, impeller 22A is rotated around axis $\Delta_A$ along arrow 79. The quenching gas is sucked in through intake opening 76A of impeller 22A and is expelled through discharge openings 78A along the entire periphery of impeller 22A radially and towards the back.

For each half-volute 40A, 40B, 42A, 42B, in the guiding position, planar external wall 45A, 45B, 48A, 48B of half-volute 40A, 40B, 42A, 42B substantially prolong base flange 52A, 52B of the associated impeller 22A, 22B. Further, planar inner wall 44A, 44B, 47A, 47B of half-volute 40A, 40B, 42A, 42B extends in line with cylindrical wall 50A, 50B. Lateral wall 43A, 43B, 46A, 46B of half-volute 40A, 40B, 42A, 42B covers discharge openings 78A, 78B of the associated impeller 22A, 22B on one half of the periphery of impeller 22A, 22B.

For each half-volute 40A, 40B, 42A, 42B, in the screening position, external planar wall 45A, 45B, 48A, 48B of half-volute 40A, 40B, 42A, 42B is in line with cylindrical lateral wall 72A, 72B and inner planar wall 44A, 44B, 47A, 47B is in line with cylindrical wall 50A, 50B. Lateral wall 43A, 43B, 46A, 46B of half-volute 40A, 40B, 42A, 42B extends between cylindrical wall 72A, 72B and cylindrical wall 50A, 50B. Half-volute 40A, 40B, 42A, 42B, cylindrical wall 72A, 72B, separation plate 36A, 36B, and cylindrical wall 50A, 50B then form a screen which prevents or strongly decreases the quenching gas flow.

Half-volutes 40A, 40B, 42A, 42B are displaced so that, when upper half-volutes 40A, 40B are in the guiding position, as shown in FIG. 1, lower half-volutes 42A, 42B are in the screening position and that, when upper half-volutes 40A, 40B are in the screening position, as shown in FIG. 2, lower half-volutes 42A, 42B are in the guiding position.

In the configuration shown in FIG. 1, when impellers 22A, 22B are rotated, the quenching gas substantially flows along arrows 80 and, in particular, from bottom to top at the level of load 14. Indeed, each lower half-volute 42A, 42B, in screening position, prevents or strongly decreases the quenching gas intake by the associated impeller 22A, 22B from lower area 38A, 38B. Thereby, most of the quenching gas sucked in by impeller 22A, 22B originates from upper area 37A, 37B. Further, each upper half-volute 40A, 40B, in guiding position, guides the flow expelled by the associated mixed-flow impeller 22A, 22B towards lower area 38A, 38B.

In the configuration shown in FIG. 2, when impellers 22A, 22B are rotated, the quenching gas substantially flows along arrows 81 and, in particular, from top to bottom at the level of load 14. Indeed, each upper half-volute 40A, 40B, in screening position, prevents or strongly decreases the quenching gas intake by the associated impeller 22A, 22B from upper area 37A, 37B. Thereby, most of the quenching gas sucked in by impeller 22A, 22B originates from lower area 38A, 38B. Further, each lower half-volute 42A, 42B, in guiding position, guides the flow expelled by the associated mixed-flow impeller 22A, 22B towards upper area 37A, 37B.

As an example, in operation, impellers 22A, 22B circulate the quenching gas at the level of load 14 with a flow rate of a few cubic meters per second.

The quenching gas flow direction at the level of load 14 can thus be reversed by passing from the configuration shown in FIG. 1 to the configuration shown in FIG. 2 and conversely, impellers 22A, 22B always rotating in the same direction. A quenching method may comprise one or a plurality of reversals of the quenching gas flow direction at the level of load 14.

Figure 4:
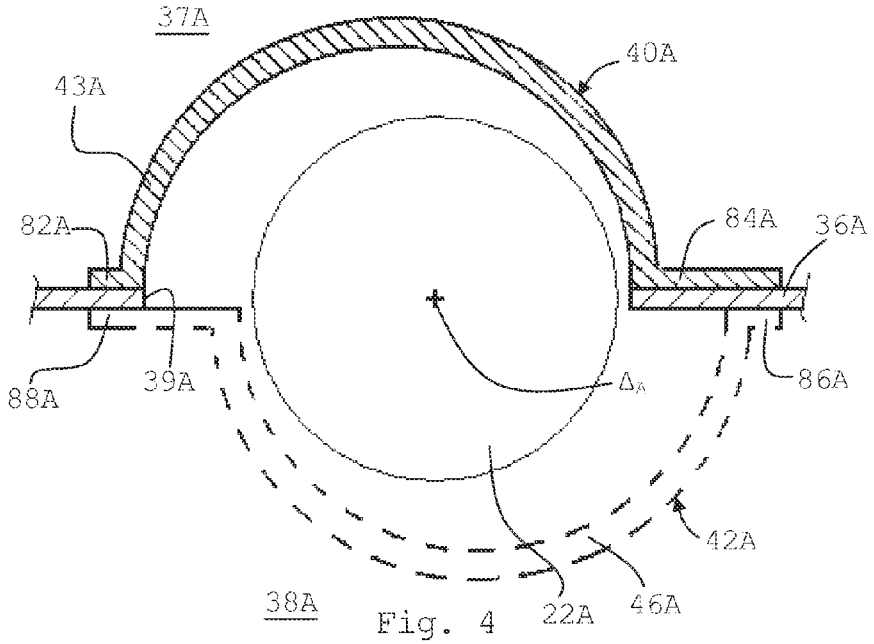
FIG. 4 is a simplified cross-section view of certain elements of the quenching cell of FIG. 1.

FIG. 4 is a partial simplified cross-section view of FIG. 1 along plane IV-IV and shows impeller 22A, half-volute 40A (in full lines), half-volute 42A (in dotted lines) and separation plate 36A. Half-volutes 40B and 42B may have a structure similar to that of half-volutes 40A, 42A. Half-volute 40A comprises bearing portions 82A, 84A which prolong lateral wall 43A and rest on the upper surface of separation wall 36A. Half-volute 40A, in guiding position, directs the gas expelled on the upper half of impeller 22A towards lower area 38A. Half-volute 42A, shown in dotted lines in guiding position, comprises bearing portions 86A, 88A which prolong lateral wall 46A and rest on the lower surface of separation wall 36A. Half-volute 42A, in guiding position, directs the gas expelled on the lower half of impeller 22A towards upper area 37A.

Figure 5:
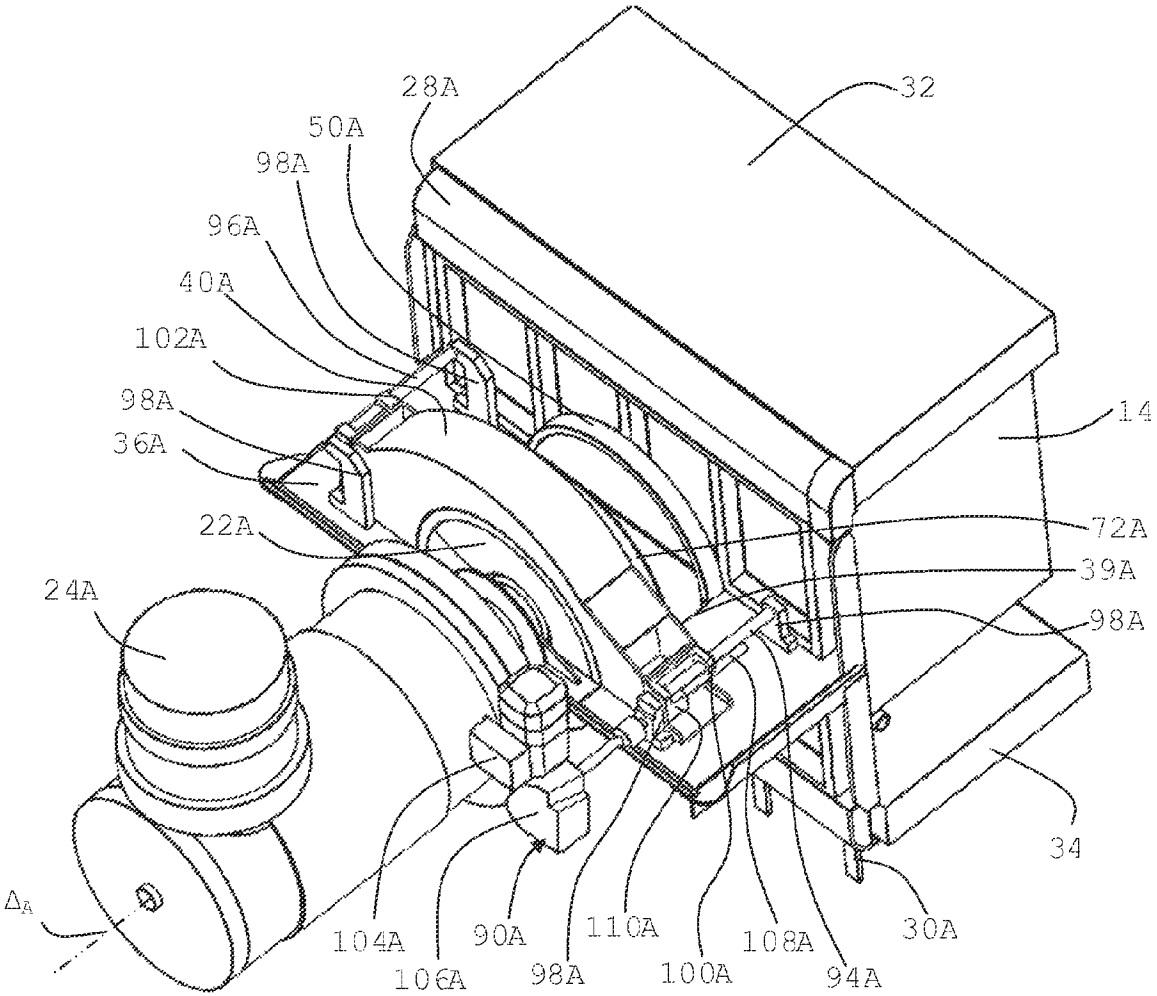
FIGS. 5 and 6 are more detailed perspective views of certain elements of the quenching cell of FIG. 1.
Figure 6:
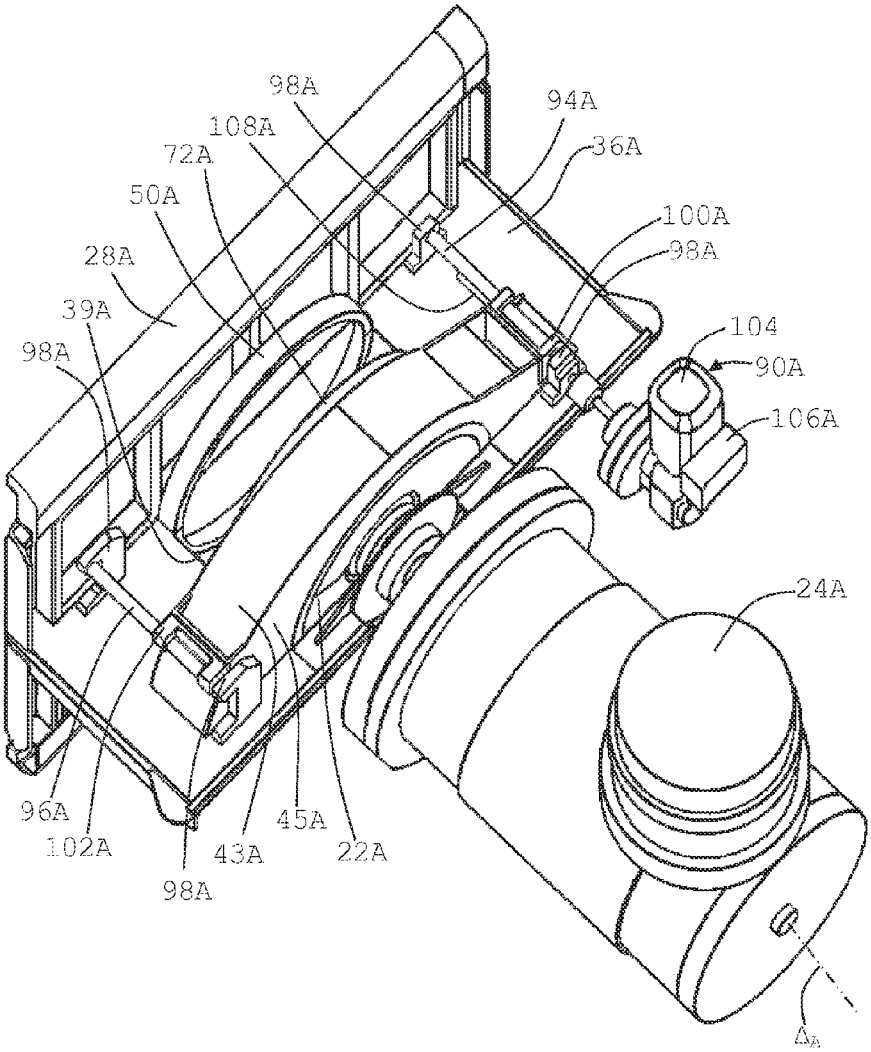

FIGS. 5 and 6 are perspective views of certain elements of quenching cell 5 of FIG. 1. These drawings only show vertical panel 28A, impeller 22A, half-volute 40A in guiding position, separation plate 36A, and motor 24A. Further, the actuation system of half-volute 40A is shown in FIGS. 5 and 6. Further, FIG. 5 shows legs 30A and heat exchangers 32, 34.

Only the actuation system of half-volute 40A is described in detail. The actuation systems of the other half-volutes may have a structure similar to the actuation system of half-volute 40A. The actuation system of half-volute 40A comprises an actuator 90A which comprises two guide rods 94A, 96A having their axes parallel to axis $\Delta_A$. Guiding rods 94A, 96A are arranged on either side of half-volute 40A and are attached at their ends to separation plate 36A by supports 98A. A carriage 100A, attached to half-volute 40A, may slide on rod 94A. A carriage 102A, attached to half-volute 40A, may slide on rod 96A. Actuator 90A comprises an electric motor 104A rotating, by a transmission system 106A, a worm 108A. The axis of worm 108A is parallel to axis $\Delta_A$. Carriage 100A comprises a portion 110A forming a nut assembled on worm 108A.

In operation, a rotation of endless screw 108A results in a shifting of portion 110A forming a nut along the axis of worm 108A, that is, parallel to axis $\Delta_A$. This results in a shifting of half-volute 40A along axis $\Delta_A$. According to the rotation direction of worm 108A, half-volute 40A is displaced from the guiding position to the screening position or from the screening position to the guiding position.

Motors 22A, 22B may be associated with speed variation devices to modify the quenching gas flow speed at the level of load 14 during a quenching operation. For this purpose, frequency variators may be used when drive motors 24A, 24B are electric motors. In the case where motors 24A, 24B are hydraulic motors, a system for varying the flow rate of the oil supplying such motors may be provided.

According to another embodiment of the present invention, half-volutes 40A, 40B, 42A, 42B cannot be shifted parallel to axes $\Delta_A$ and $\Delta_B$ but are rotatably mobile around axes $\Delta_A$ and $\Delta_B$. Based on the configuration shown in FIG. 1, each half-volute 40A, 40B, 42A, 42B may be pivoted by one half-turn around the associated axis $\Delta_A$ and $\Delta_B$. Based on the configuration shown in FIG. 1, half-volute 40A, after one half-turn, covers the lower half of the periphery of impeller 22A and half-volute 42A, after one half-turn, extends between cylindrical walls 72A and 50A in upper area 37A. Based on the configuration shown in FIG. 1, half-volute 40B, after one half-turn, covers the lower half of the periphery of impeller 22B and half-volute 42B, after one half-turn, extends between cylindrical walls 72B and 50B in upper area 37B.

Quenching cell 5 has several advantages:

Whatever the positions of the half-volutes, all the quenching gas is discharged by the impeller in the proper direction relative to the desired quenching gas flow direction at the load level. For example, in the configuration shown in FIG. 1, the gas expelled on the upper half of the impeller is guided by each upper half-volute towards the lower area of the cell and the gas expelled on the lower half of the impeller is directly expelled into the lower area of the cell. Thereby, the provided flow reversal system enables to improve by approximately 20% the efficiency of the quenching cell, according to tests performed by the inventors, as compared with a flow reversal system with a free impeller (with no volute). This is due to the fact that, in the present embodiment of the invention, the output flow is either directed in the proper direction for the impeller half which is free (without any volute), or channeled in the proper direction for the impeller half comprising a volute.

The modification of the quenching gas flow direction at the load level is obtained by displacing the half-volutes with no reversal of the impeller rotation direction. Thereby, the reversal of the flow direction of the quenching gas driven by the impellers may be performed rapidly, for example, within less than five seconds.

Further, the reversal of the quenching gas flow direction at the load level is obtained by a system having a decreased bulk.

Of course, the present invention is likely to have various alterations and modifications, which will occur to those skilled in the art. In particular, the quenching cell may be different from the previously-described cell. In particular, the axes of the centrifugal or mixed-flow impellers may be vertically arranged so that the quenching gas flows at the load level along a horizontal direction. Further, the drive shafts may be inclined with respect to the impeller axes, the drive shafts being then connected to the impellers by transmission systems, for example, comprising toothed wheels. Further, the quenching cell may comprise a single impeller for circulating the quenching gas at the load level.

The invention claimed is:

1. A gas quenching cell for a load, the cell comprising a centrifugal or mixed-flow impeller comprising a gas intake opening and gas discharge openings, the impeller being rotated by a motor to cause a gas flow between the load and a heat exchanger, the quenching cell comprising first and second mobile half-volutes, and wherein:

in a first position, the first half-volute guides the gas discharged by a first portion of the discharge openings and the second half-volute shuts off a first portion of the intake opening; and in a second position, one of the first or second half-volute guides the gas discharged by a second portion, different from the first portion, of the discharge openings, and the other one of the first or second half-volute shuts off a second portion of the intake opening.

2. The quenching cell of claim 1, comprising an actuator laterally shifting the first and second half-volutes with respect to the impeller.

3. The quenching cell of claim 1, comprising an actuator rotating the first and second half-volutes with respect to the axis of the impeller.

4. The quenching cell of claim 1, further comprising:

an enclosure containing the impeller, the load, and the heat exchanger;

a panel located between the impeller and the load; and a plate connecting the enclosure to the panel and surrounding the impeller, the first and second half-volutes being arranged on either side of the plate.

5. The quenching cell of claim 4, comprising a cylindrical wall in contact with the panel and wherein, in the first position, the second half-volute extends between the impeller and the cylindrical wall and wherein, in the second position, the first half-volute extends between the impeller and the cylindrical wall.

6. The quenching cell of claim 2, wherein the actuator comprises a worm and a nut fastened to the first half-volute and cooperating with the worm.

7. The quenching cell of claim 2, comprising an additional centrifugal or mixed-flow impeller, the impeller and the additional impeller being arranged on either side of the load, the cell further comprising additional third and fourth mobile half-volutes, wherein:

in the first position, the third half-volute guides the gas discharged by a first portion of the discharge openings of the additional impeller and the fourth half-volute shuts off a first portion of the intake opening of the additional impeller; and in the second position, one of the third or fourth half-volute guides the gas discharged by a second portion of the discharge openings of the additional impeller, different from the first portion of the discharge openings of the additional impeller, and the other one of the third or fourth half-volute shuts off a second portion of the intake opening of the addition impeller.

8. The quenching cell of claim 1, wherein the impeller is a mixed-flow impeller.

9. A method of gas quenching of a load in the quenching cell of claim 1, the method comprising the steps of:

displacing the first and second half-volutes to the first position, the gas flowing at the load level in a first flow direction; and displacing the first and second half-volutes to the second position, the gas flowing at the load level in a second flow direction opposite to the first flow direction.

* * * * *